US005910468A

United States Patent [19]

Dohhen et al.

[11] Patent Number: 5,910,468

[45] Date of Patent: Jun. 8, 1999

[54] PROCESS FOR THE PREPARATION OF CALCIUM PHENATE DETERGENTS FROM CASHEW NUT SHELL LIQUID

[75] Inventors: Khem Chand Dohhen; Harish Chander Bhatia; Krishan Kumar Swami; Rakesh Sarin; Deepak Kumar Tuli; Madan Mohan Rai; Akhilesh Kumar Bhatnagar, all of Faridabad, India

[73] Assignee: Indian Oil Corporation Ltd., Bombay, India

[21] Appl. No.: 09/055,213

[22] Filed: Apr. 6, 1998

[51] Int. Cl.[6] ..... C10M 159/22

[52] U.S. Cl. ..... 508/332; 508/333; 508/574

[58] Field of Search ..... 508/332, 333, 508/574

[56] References Cited

U.S. PATENT DOCUMENTS

| | | | |
|---|---|---|---|
| 4,125,496 | 11/1978 | McGinnis | 523/159 |
| 4,664,824 | 5/1987 | Chang et al. | 508/574 |
| 4,710,308 | 12/1987 | Stauffer | 508/574 |
| 5,250,588 | 10/1993 | Delvaux et al. | 523/159 |
| 5,330,665 | 7/1994 | Cane et al. | 508/574 |
| 5,595,266 | 1/1997 | Cecere | 188/251 |

*Primary Examiner*—Jacqueline V. Howard
*Attorney, Agent, or Firm*—Spencer & Frank

[57] ABSTRACT

A process for the preparation of sulphurized calcium phenate from cashew nut shell liquid (CNSL). Distilled or hydrogenated distilled CNSL is reacted with calcium salt and sulphur in the presence of promoters to obtain a reaction mixture. The reaction mixture is subjected to the step of carbonation to obtain basic sulfurized calcium phenate, which may be subjected to a further step of basefication to obtain overbased sulphurized calcium phenate. Such a calcium phenate is added to lubricating oil or grease as an additive.

10 Claims, No Drawings

PROCESS FOR THE PREPARATION OF CALCIUM PHENATE DETERGENTS FROM CASHEW NUT SHELL LIQUID

FIELD OF THE INVENTION

This invention relates to a process for the preparation of calcium phenate detergents from cashew nut shell liquid which may advantageously employed in a lubricant so as to impart suitable properties of detergency, heat resistance and acid neutralisation.

PRIOR ART

Cashew nut shell liquid (CNSL) occurs as a reddish brown viscous liquid in the soft honeycomb structure of the shell of cashewnut. The cashewnut shell is about 0.3 cm thick, having a soft leathery outer skin and a thin hard inner skin. Between these skins is the honeycomb structure containing the phenolic material popularly known as CNSL. Inside the shell is the kernel wrapped in a thin brown skin, known as the testa.

The nut thus consists of the kernel (20–25%), the shell liquid (20–25%) and the testa (2%), the rest being the shell. CNSL, extracted with low boiling petroleum ether, contains about 90% anacardic acid and about 10% cardol. CNSL, on distillation, gives the pale yellow phenolic derivatives, which are a mixture of biodegradable unsaturated m-alkylphenols, including cardanol. Catalytic hydrogenation of these phenols gives a white waxy material, predominantly rich in tetrahydroanacardol.

CNSL and its derivates have been known for producing high temperature phenolic resins and friction elements, as exemplified in U.S. Pat. Nos. 4,395,498 and 5,218,038. Friction lining production from CNSL is also reported in U.S. Pat. No. 5,433,774. Likewise, it is also known to form different types of friction materials, mainly for use in brake lining system of automobiles and coating resins from CNSL.

Metal phenates and sulphurised metal phenates are one of the detergents for use in lubricating oils, for mainly internal combustion engines, and these function to neutralize acid substances, sludge etc., generated in engines. Thus the metallic phenates, generally alkaline earth metal phenates, protects engine parts, from excessive corroding caused by acidic substances, generated in engines and prevents engine parts from excessive wear caused by sludge. The overbasing of these phenates helps in fighting the acid generated during fuel combustion, and their sulphurisation mainly helps to improve heat stability and oil solubility.

The conventional method of making overbased metallic sulphurised phenates, useful as lubricating oil additives, involves reacting long chain alkyl substituted phenols, generally para substituted, a source of sulphur, metal salt and subsequent carbonation. The major problems encountered during the formation of phenates from alkylated phenol is their low solubility in oil and the remaining undissolved solid, causing problems in filteration during manufacture. Attempts have been made to partially overcome these problems by incorporation of various dispersants, which however add to process cost, as the resultant alcohols have to be distilled off at very high vacuum (U.S. Pat. No. 5, 223,163). The prior art methods of producing overbased metallic phenates have the disadvantages that the products had very high viscosity, and were difficult to handle as such.

OBJECTS OF THE INVENTION

An object of this invention is to propose a process for the preparation of various neutral and overbased calcium sulphurised phenates derived from cashew nut shell liquid, which when blended into lubricants, provide effective protection against corrosive wear and sludge formation.

Another object of this invention is to propose a lubricant and grease composition having overbased calcium sulfurised phenates obtained from CNSL and which provides effective protection against corrosive wear and sludge formatiom.

DESCRIPTION OF THE INVENTION

According to this invention, there is provided a process for the preparation of normal and overbased calcium sulfurised phenates, for use as an additive in a lubricant composition, comprising in the steps of:

a) reacting distilled CNSL with calcium salt such as calcium oxide or calcium hydroxide and sulphur, in the presence of promoters selected from alcohol, glycol and mineral oil to obtain a reaction mixture;

b) subjecting said reaction mixture to the step of carbonation;

c) and, if required, further overbasing with carbon dioxide, in the presence of an acid.

Further according to this invention, there is provided a lubricant comprising of a major portion of an oil of lubricating viscosity or grease and the remainder being an additive comprising of normal or overbased calcium sulphurised phenate, derived from distilled CNSL.

In accordance with the present invention, the process for preparation of novel normal and overbased calcium sulphurised phenates, for use in lubricants, comprises in reacting cashew nut shell liquid with calcium oxide or calcium hydroxide and sulphur, in the presence of promoters. This invention is more particularly directed to lubricant compositions containing minor additive concentrations of normal and overbased calcium sulphurised phenates derived from distilled or hydrogentaled distilled cashew nut shell liquid, and a major amount of oil of proper lubricating viscosity, which exhibit excellent detergency and acid neutralisation properties. Concentrations as little as 1% in fully formulated synthetic and mineral oil based formulations reduce the deposit formation considerably and thus protect the engine parts from corrosive wear and lacquer. Additionally, the compounds of present invention provide excellent protection at high temperature and act as antioxidants.

In consideration to the problems involved in the prior art, it was surprisingly discovered that overbased calcium phenates derived from cashew nut shell liquid had low viscosity at high basicity, good oil solubility and could be prepared in economically advantageous manner.

Novel composition disclosed herein are expected to provide exceptional benefits, in a variety of synthetic and mineral oil based lubricants and greases, in terms of superior performance, ease of preparation and handling.

In preparation of the neutral or overbased sulphurised calcium phenates of the present invention, distilled or hydrogentated distilled cashew nut shell liquid, a naturally occurring biodegradable, cheap and abundantly available material, is used as a raw material. The overbased sulphurised calcium phenates of the present invention are produced by a step of reaction of the above raw material, i.e., distilled or hydrogenated distilled CNSL, with sulphur, calcium oxide or hydroxide and a dihydric alcohol, through a step of treatment with carbon dioxide, providing basic sulphurised calcium phenates.

The amount of sulphur used herein is not particularly limited, but preferably 0.1 to 0.5 mole per mole of CNSL. It was found that within this range of sulphur, best yields and highest TBN values were obtained. Also the solubility of the product in mineral or synthetic oil was maximum within this range of sulphur.

The type of calcium salt is not particularly limiting. Both calcium oxide and calcium hydroxide or mixtures thereof could be used in an amount equivalent to 0.2 to 1.0 mole per mole of CNSL.

Various kinds of dihydric alcohols may be used without any particular limitation. However, those with relatively low boiling point, low viscosity and high reactivity may be used in view of ease of preparation. Particularly those having 2 to 6 carbon atoms are preferred. Dihydric alcohols include ethylene glycol, diethylene glycol, propylene glycol and the like. The amount of dihydric alcohol used is 0.1 to 2.0 moles, and preferably 0.4 to 1.2 mole per mole of CNSL. When the amount of dihydric alcohol is less than 0.1 mole, the yield is reduced, while excess than 2.0 moles requires prolonged distillation for its removal, after the reaction.

The amount of carbon dioxide used is 5 to 65 mol %, preferably 20 to 40 mol % per mole of calcium salt.

The overbased sulphurised calcium phenates of the present invention can be obtained by two steps, i.e., a step of producing basic sulphurised alkaline earth metal phenates and a subsequent overbasification step.

In the first step for the production of overbased sulphurised calcium phenates of the present invention, initially basic sulphurised calcium phenates are obtained. Specifically, the raw material mixture consisting of distilled CNSL or distilled hydrogenated CNSL, sulphur, calcium oxide or calcium hydroxide, and dihydric alcohol is reacted, under suitable conditions, e.g., at 110–190° C. Subsequently, water and dihydric alcohol are distilled off from the reaction mixture, then treatment with carbon dioxide is carried out either in a open vessel or in an autoclave, e.g., at 100–180° C., under carbon dioxide pressure from ambient pressure to 200 psi. In the production step of above basic sulphurised calcium phenates, diluent may be or may not be used. Example of preferred diluent include paraffinic, naphethenic, aromatic mineral oil or a mixture thereof.

If needed, the resulting basic sulphurised metal phenate is subjected to further overbasification, by addition of calcium oxide or hydroxide, mono and/or dihydric alcohol; carbon dioxide and a solvent to the basic sulphurised calcium phenate of the present invention.

Further the above lubricating oil additive, i.e., overbased sulphurised calcium phenate, may be compounded with lubricating oil to produce the lubricating oil compositions of the present invention. The lubricants contemplated for use herein include both mineral and synthetic hydrocarbon oils of lubricating viscosity, mixtures of minerals and synthetic oils and greases prepared therefrom. Typical synthetic oils are: polypropylene glycol, trimethylol propane esters, neopentyl and pentaerythritol esters, polyethylene glycol, di(2-ethylhexyl)adipate, fluorocarbons, siloxanes phenoxy phenyl ethers and poly alphaolefins.

The amount of additive in the lubricant compositions may range from 0.2 to about 30% by weight of the total lubricant composition. Preferred is from 1.0 to 5 wt %. Other additives which may be present include polyalkyl succinimide and polyalkenyl ester dispersants, metallic (calcium or magnesium) sulfonates, metallic phosphorodithioates, aminic or phenolic antioxidants, defoaming agents, polymeric viscosity index improves and other additives used in lubricants.

The lubricating oil compositions with the additives of present invention are excellent in detergency-dispersancy, heat stability, solubility in oil, and is highly economical, since the basic raw material of the present invention consists of naturally occuring, biodegradable, abundantly available, cheap cashew nut shell liquid.

The following examples illustrate the invention, but without intending to imply any limitation thereon.

EXAMPLE 1

To a two liter round bottom flask, equipped with condenser, Dean & Stark trap, carbon dioxide and vacuum inlet, thermometer and a variable speed stirrer, was charged 232.5 g of hydrogenated distilled cashew nut shell liquid, 127 g calcium hydroxide, 141 g of 150N mineral oil, 90 g of 2-ethylhexanol and 40 g of elemental sulphur. The mixture was purged with nitrogen and the temperature was raised to 120° C., with stirring 51 ml of ethylene glycol was added to the reaction mixture dropwise and temperature raised to 175° C., while continuing the nitrogen purge for a period of 2 hours. While maintaining the temperature at 175° C., carbon dioxide (64 g) was bubbled through the reaction mixture, over a period of 2 hours, when the color of the reaction mixture changed to reddish orange. The reaction mixture was then allowed to cool, diluted with 1.0 liter of toluene and allowed to stand for two hours at room temperature. The toluene solution was filtered and the toluene was removed under reduced pressure from the filtrate to yield about 493 g of the desired product. The total base number of the sample was 230 and the viscosity 65.9 cSt at 100° C.

EXAMPLE 2

To a two liter round bottom flask, equipped with condensar, Dean & Stark trap, carbon dioxide and vacuum inlet, thermometer and a variable speed stirrer, was charged 231.0 g of distilled cashew nut shell liquid, 127 g calcium hydroxide, 141 g of 151N mineral oil, 90 g of 2 ethylhexanol and 28 g of elemental sulphur The mixture was purged with nitrogen and the temperature was raised to 120° C., with stirring, 51 ml of ethylene glycol was added to the reaction mixture dropwise and temperature raised to 175° C., while continuing the nitrogen purge for a period of 2 hours. While maintaining the temperature at 175° C., carbon dioxide (64 g) was bubbled through the reaction mixture, over a period of 2 hours, when the color of the reaction mixture changed to reddish brown. The reaction mixture was then allowed to cool, diluted with 1.0 liter of toluene and allowed to stand for two hours at room temperature. The toluene solution was filtered and the toluene was removed under reduced pressure from the filtrate to yield about 455 g of the desired product. The total base number of the sample was 222 and the viscosity 70.8 cSt at 100° C.

EXAMPLE 3

The same operation as in example 1 was carried out with the exception that the reaction was carried out in an autoclave at a pressure of 120 psi and the amount of carbon dioxide added to the autoclave was reduced to 48 g. The total base number of the product was found to be 219 and viscosity 69.6 cst at 100° C.

EXAMPLE 4

To a one liter round bottom flask, equipped with condensar, Dean & Stark trap, carbon dioxide and vacuum inlet, thermometer and a variable speed stirrer, was charged 116 g of hydrogenated distilled cashew nut shell liquid, 70 g calcium hydroxide, 70 g of 150N mineral oil, 55 g of cyclohexanol and 22 g of elemental sulphur. The mixture was purged with nitrogen and the temperature was raised to 120° C., with stirring. Ethylene glycol (30 ml) was added to the reaction mixture dropwise and temperature raised to 175° C., while continuing the nitrogen purge for a period of 2 hours. While maintaining the temperature at 175° C., carbon dioxide (35 g) was bubbled through the reaction mixture, over a period of 1 hour, when the color of the reaction mixture changed to reddish orange. The reaction mixture was then allowed to cool, diluted with 0.7 liter of toluene and allowed to stand for two hours at room temperature. The toluene solution was filtered and the toluene was removed under reduced pressure from the filtrate to yield about 273 g of the desired product. The total base number of the sample was 247 and the viscosity 63.7 cSt at100° C.

EXAMPLE 5

To a one liter round bottom flask, equipped with condenser, Dean & Stark trap, carbon dioxide and vacuum inlet, thermometer and a variable speed stirrer, was charged 110 g of distilled cashew nut shell liquid, 63 g calcium hydroxide, 65 g of 500N mineral oil, 55 g of cyclohexanol and 28 g of elemental sulphur. The mixture was purged with nitrogen and the temperature was raised to 120° C., with stirring. 1,2-propanediol (30 ml) was added to the reaction mixture dropwise and temperature raised to 175° C., while continuing the nitrogen purge for a period of 2 hours. While maintaining the temperature at 175° C., carbon dioxide (35 g) was bubbled through the reaction mixture, over a period of 1 hour, when the color of the reaction mixture changed to reddish orange. The reaction mixture was then allowed to cool, diluted with 0.7 liter of toluene and allowed to stand for two hours at room temperature. The toluene solution was filtered and the toluene was removed under reduced pressure from the filtrate to yield about 258 g of the desired product. The total base number of the sample was 209 and the viscosity 73.5 cSt at 100° C.

Comparative Example 1

The same operation as in example 1 was carried out with the exception that commercial dodecylphenol (200 g) was used. The properties and performance of the synthesised product are given in Tables 1, 2 & 3.

Comparative Example 2

The same operation as in example 1 was carried out with the exception that commercial hexadecylphenol (240 g) was used. The properties and performance of the synthesised product are given in Tables 1, 2 & 3.

Comparative Example 3

The same operation as in example 1 was carried out with the exception that a mixture of commercial nonylphenol (57 g), dodecyphenol (66 g) and hexadecylophenol (80 g) was used. The properties and performance of the synthesised product are given in Tables 1, 2 & 3.

Performance evaluation of products

Table 1 shows the properties of overbased sulphurised calcium phenates obtained in examples and comparative examples. Table 2 shows the compounding concentration of the lubricating oil composition containing other additives and overbased sulphurised calcium phenates of examples and comparative examples. Table 3 shows properties, performance and solubilites of the lubricating oil composition, formulated according to Table 2.

TABLE 1

| SAMPLE | BASE VALUE (mg KOH/g) | Ca (wt %) | S (wt %) |
|---|---|---|---|
| Example 1 | 230 | 8.8 | 3.1 |
| Example 2 | 222 | 8.5 | 2.6 |
| Example 3 | 219 | 8.2 | 4.3 |
| Example 4 | 247 | 8.9 | 3.7 |
| Example 5 | 209 | 8.6 | 3.5 |
| Comparative Example 1 | 202 | 8.3 | 3.6 |
| Comparative Example 2 | 225 | 8.5 | 3.8 |
| Comparative Example 3 | 236 | 8.3 | 3.1 |

TABLE 2

| | 150N mineral oil (%) | 500N mineral oil (%) | Calcium Phenate type | Calcium Phenate (%) | Calcium Sulphonate* (%) | PIBS Dispersant (%) |
|---|---|---|---|---|---|---|
| Composition 1 | 80.0 | 15.0 | Example 1 | 2.0 | 2.0 | 1.0 |
| Composition 2 | 80.0 | 15.0 | Example 2 | 2.0 | 2.0 | 1.0 |
| Composition 3 | 80.0 | 15.0 | Example 3 | 2.0 | 2.0 | 1.0 |
| Composition 4 | 80.0 | 15.0 | Example 4 | 2.0 | 2.0 | 1.0 |
| Composition 5 | 80.0 | 15.0 | Example 5 | 2.0 | 2.0 | 1.0 |
| Composition 6 | 60.0 | 15.0 | Comparative Example 1 | 2.0 | 2.0 | 1.0 |
| Composition 7 | 80.0 | 15.0 | Comparative Example 2 | 2.0 | 2.0 | 1.0 |
| Composition 8 | 80.0 | 15.0 | Comparative Example 3 | 2.0 | 2.0 | 1.0 |
| Composition 9 | 80.0 | 12.5 | Comparative Example 3 | 3.8 | 2.7 | 1.0 |
| Composition 10 | 80.0 | 12.5 | Comparative Example 3 | 3.8 | 2.7 | 1.0 |

*Total base value: 300 (mg KOH/g)

TABLE 3

PERFORMANCE EVALUATION OF FORMULATED COMPOSITIONS

| | Base Value* (mg KOH/g) | Panel Coking Test** Wt. of deposits (mg) | IP-48 Test*** % Change in KV at 40' C. | Hot Oil Oxidation Test**** % Change in KV at 40' C. | Oil Solubility (60' C., 5 days) |
|---|---|---|---|---|---|
| Composition 1 | 10.6 | 34 | 2.1 | 76.5 | ok |
| Composition 2 | 10.4 | 41 | 3.4 | 68.7 | ok |
| Composition 3 | 10.4 | 36 | 2.9 | 72.3 | hazy |
| Composition 4 | 11.0 | 29 | 3.0 | 66.5 | ok |
| Composition 5 | 10.2 | 27 | 1.9 | 77.9 | ok |
| Composition 6 | 10.0 | 62 | 4.6 | 98.7 | ok |
| Composition 7 | 10.5 | 68 | 5.5 | 100.6 | hazy |
| Composition 8 | 10.7 | 36 | 4.2 | 72.5 | ok |
| Composition 9 | 16.7 | 37 | 3.8 | 77.3 | ok |
| Composition 10 | 17.1 | 43 | 3.3 | 89.5 | hazy |

*Total Base Number was determined as per ASTM D-2896 test method.
**Panel Coking Test was carried out according to Fed 791B Method 3462 (1969).
***IP-48 test was carried out as per standrd procedure.
****Hot Oil Oxidation Test was carried out as follows: Air (10 lt/hr) was through a lubricating oil composition (27 gms), at 156' C., for 64 hrs., in the presence of copper and iron naphthenate catalysts. Percentage increase in viscosity was estimated.

We claim:

1. An overbased calcium salt of sulphurised distilled cahew nut shell liquid.

2. A lubricant composition comprising of a major portion of an oil of lubricating viscosity and the remainder being an additive comprising of normal or overbased sulphurises calcium phenate derived from distilled cashew nut shell liquid therefor and present in an amount 0.2 to 30%, and preferably 1 to 15% by weight of total lubricant composition.

3. A process for the preparation of sulfurised calcium phenates, for use as an additive in a lubricant composition, comprising in the steps of:

a) reacting distilled cashew nut shell liquid therefor with calcium salt selected from calcium oxide or calcium hydroxide and sulphur, in the presence of promoters selected from alcohol, glycol and mineral oil to obtain a reaction mixture;

b) subjecting said reaction mixture to the step of carbonation to obtain basic sulfurised calcium phenate.

4. A process as claimed in claim 3 wherein the basic sulphurized calcium phenate is subjected to further over basicification to obtain overbased sulfurized calcium phenate.

5. A process as claimed in claim 3, wherein sulphur is used in an amount of from about 0.1 to 0.5 moles per mole of said distilled cashew nut shell liquid therefor.

6. A process as claimed in claim 3, wherein said carbon dioxide treatment is carried out, in an amount of from about 5 to 65 mol % per mole of said calcium metal salt.

7. A process as claimed in claim 3 wherein said carbon dioxide treatment is carried out in an amount of 20 to 40 mol % per mole of said calcium metal salt.

8. A process as claimed in claim 3 wherein the dihydric alcohols are chosen from ethylene glycol, diethylene glycol and propylene glycol, and mixtures thereof.

9. A process as claimed in claim 3 wherein the calcium salt is added in an amount of 0.2 to 1.0 mole per mole of cashew nut shell liquid therefor.

10. A process as claimed in claim 3 wherein the distilled cashew nut shell liquid therefor is hydrogenated distilled cashew nut shell liquid therefor.

* * * * *